US006719154B2

(12) United States Patent
Kao

(10) Patent No.: US 6,719,154 B2
(45) Date of Patent: Apr. 13, 2004

(54) TOOL DISPLAY DEVICE

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 0 days.

(21) Appl. No.: 10/208,955

(22) Filed: Jul. 30, 2002

(65) Prior Publication Data

US 2004/0020880 A1 Feb. 5, 2004

(51) Int. Cl.[7] ..... A47F 7/00

(52) U.S. Cl. ..... 211/70.6; 206/349; 206/481; 248/688

(58) Field of Search ..... 211/70.6, 69; 248/688, 248/349, 377, 309.1, 222.11, 222.12, 214, 682, 693, 317; 206/376, 346, 377, 806, 481, 495, 378, 349, 477–479, 480–482

(56) References Cited

U.S. PATENT DOCUMENTS 4,634,005 A * 1/1987 Kulzer et al. ..... 206/477
4,813,642 A * 3/1989 Matsui ..... 248/221.11
5,044,591 A * 9/1991 Huang ..... 248/317
5,788,303 A * 8/1998 Chia-Hsiang ..... 294/143
5,906,350 A * 5/1999 Kao ..... 248/688
6,076,669 A * 6/2000 Ling ..... 206/349
6,164,463 A * 12/2000 Lee ..... 211/70.6
6,193,200 B1 * 2/2001 Kao ..... 248/309.1
6,241,092 B1 * 6/2001 Vasudeva ..... 206/349
6,283,311 B1 * 9/2001 Lee ..... 211/70.6
6,315,119 B1 * 11/2001 Lee ..... 206/349
6,375,005 B1 * 4/2002 McCann ..... 206/349
6,378,700 B1 * 4/2002 Tong ..... 206/376
6,464,840 B1 * 10/2002 McCann ..... 206/376
6,578,711 B1 * 6/2003 Chou ..... 206/467
2002/0175257 A1 * 11/2002 Yen ..... 248/309.1
2003/0062277 A1 * 4/2003 Chen ..... 206/349
2003/0102275 A1 * 6/2003 Kao ..... 211/70.6
2003/0141266 A1 * 7/2003 Lin ..... 211/70.6

* cited by examiner

*Primary Examiner*—Jennifer E. Novosad
(74) *Attorney, Agent, or Firm*—Jackson Walker LLP

(57) ABSTRACT

A tool display device consists of a back-plate (10) and a tool bracket (20) to hang a tool on the tool display device. The back-plate (10) has two holding plates (11) respectively formed at two sides of the back-plate (10). Each holding plate (11) forms a mounting slot (12) with the back-plate (10). The tool bracket (20) has two ears (22). Each ear (22) slides into and is securely held in the corresponding mounting slot (12) by a hook (27) on a distal end of a resilient outside leg (26) formed on the ear (22). The tool display device further has at least one cushion secured on the tool to keep the tool stable.

18 Claims, 11 Drawing Sheets

TOOL DISPLAY DEVICE

BACKGROUND OF THE INVENTION

1. Field of the Invention

The present invention relates to a tool display device, and more particularly a tool display device that holds a tool and provides security and anti-thief features when displaying a tool with a tool head.

2. Description of Related Art

With reference to FIG. 13, a conventional tool display device in accordance with the prior art is composed of a back-plate (50) and a tool bracket (60) attached to the back-plate (50).

The back-plate (50) is rectangular and has a bottom edge, a top edge and two side edges. Two mortises (51) are respectively defined near the bottom edge and opposite side edges of the back-plate (50). A through hole (52) is defined in the back-plate (50) between each mortise (51) and the side edge.

The tool bracket (60) is substantially U-shaped with a receiving space (61) to hold a tool (not shown) and has two sides. An ear (62) is formed at each side of the receiving space (61). Each ear (62) has a face (not numbered) to abut the back-plate (50) and a lipped protrusion (64) formed on the face to engage the corresponding mortise (51) to attach the tool bracket (60) to the back-plate (50) to suspend a tool between the back-plate (50) and the tool bracket (60). A through hole (65) is defined in each ear (62) near lipped protrusion (64) to align with the corresponding through hole (52) in the back-plate (50). A plug (63) with shaft and two ends has a head (not numbered) on one end and a lip (not numbered) on the other end. The shaft is partially split longitudinally so the lip and the shaft can be pressed through the through hole (65) in the ear (62) and the through hole in the back-plate (52) and provide an anti-thief feature.

However, the conventional tool display device still has the following drawbacks caused from its structure:

1. The lipped protrusion (64) on the tool bracket (60) detachably engages the mortise (51) in the back-plate (50) to hold the tool on the tool display device. However, the lipped protrusion (64) is easily broken when the tool bracket (60) detaches from the back-plate (50) several times or when the tool bracket (60) holds a heavy tool. Therefore, the conventional display device is not durable.

2. When using the lipped protrusion (64) and the mortise (52) to mount the tool, the conventional display device further needs the plug (63) to achieve the anti-thief effect. Therefore, manufacturers need two attachment processes to complete the conventional tool display device, and that makes the assembly of the conventional tool display device unnecessarily time-consuming and troublesome. Furthermore, production cost of the conventional tool display device is also raised.

To eliminate the foregoing disadvantages of the conventional tool display device, the present invention provides a tool display device conveniently assembled, which stably holds a tool on the tool display device.

SUMMARY OF THE INVENTION

A first objective of the invention is to provide a tool display device that is convenient to assemble or disassemble.

A second objective of the invention is to provide a tool display device that holds a tool stably.

Other objects, advantages and novel features of the invention will become more apparent from the following detailed description when taken in conjunction with the accompanying drawings.

DETAILED DESCRIPTION OF THE PREFERRED EMBODIMENT

Figure 1:
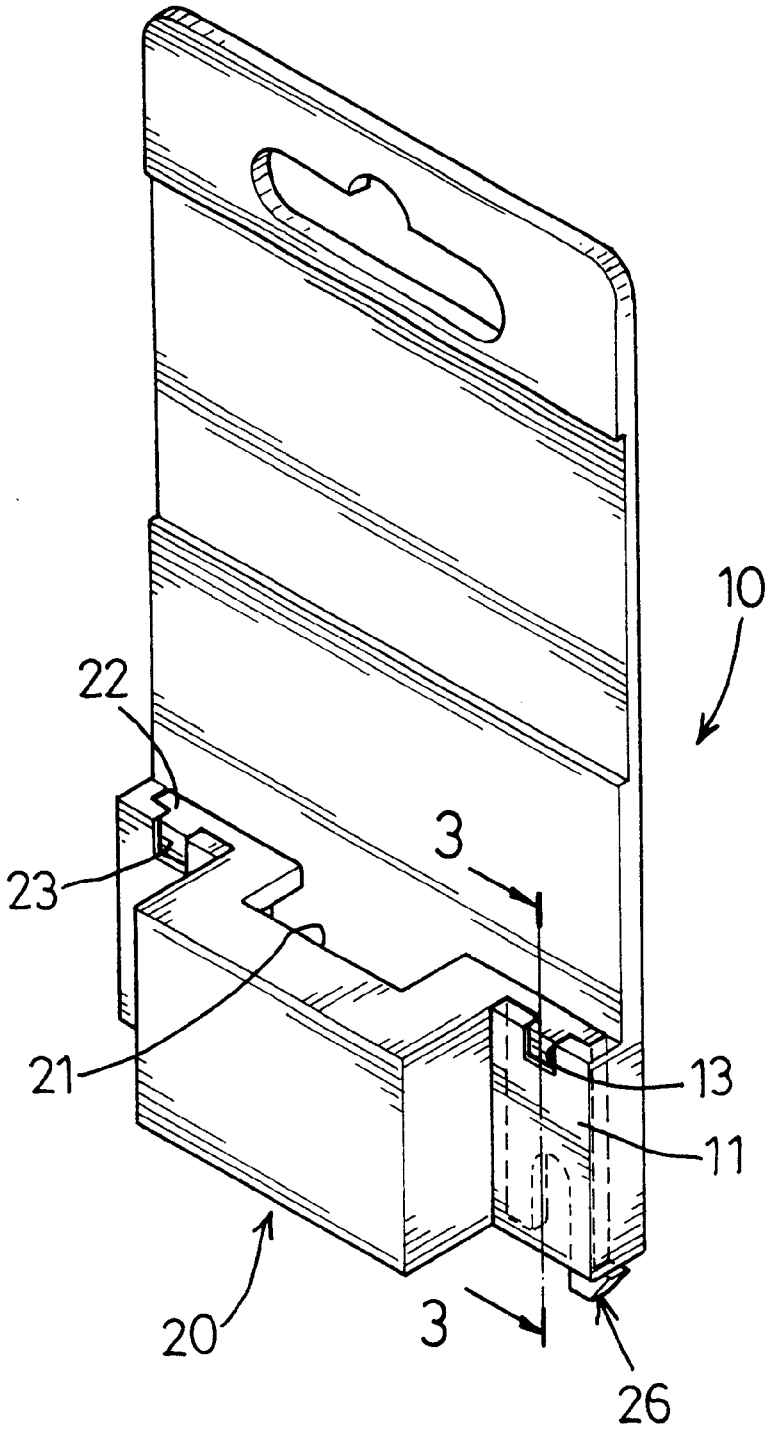
FIG. 1 is a perspective view of a tool display device in accordance with the present invention.
Figure 2:
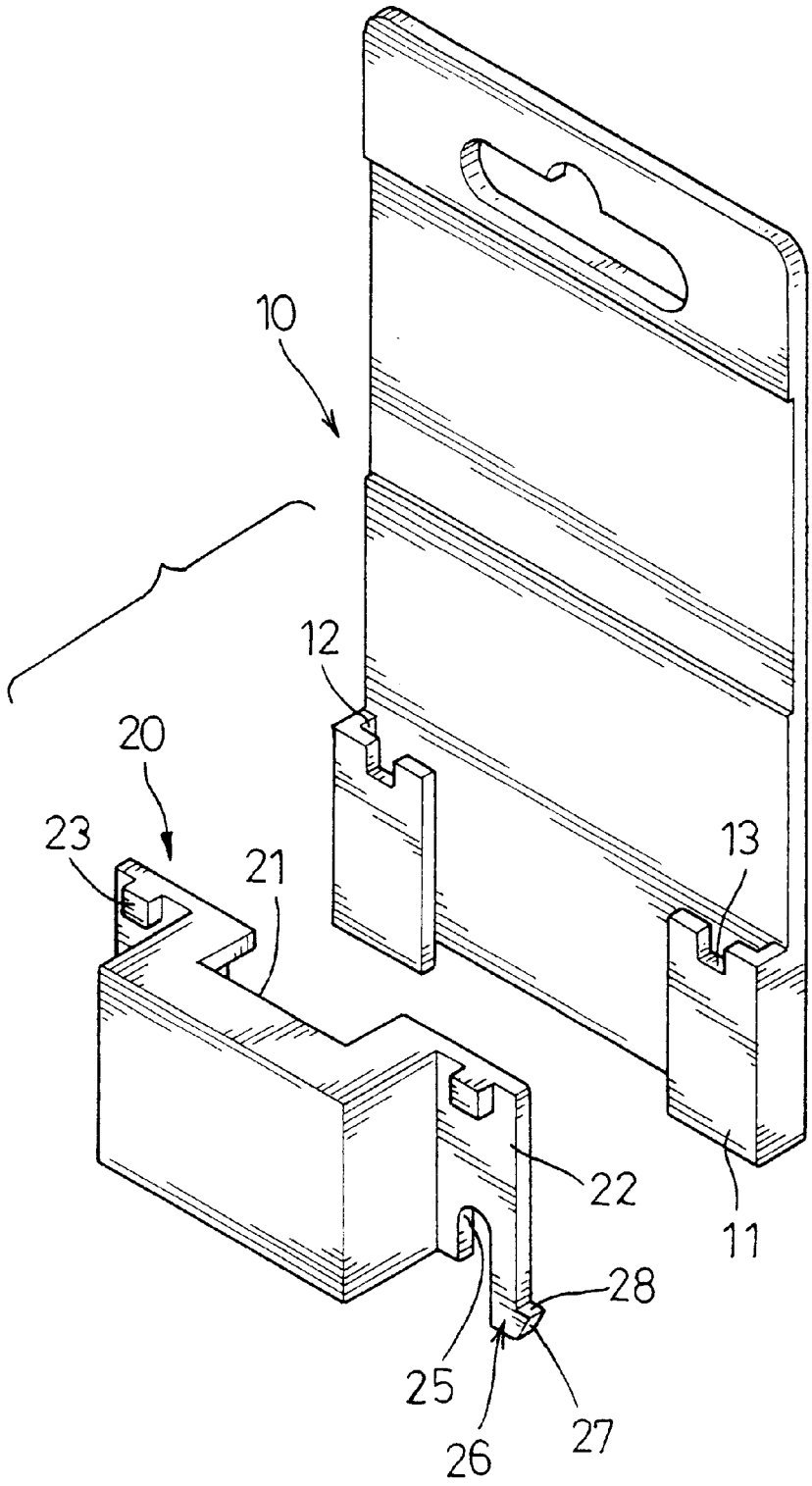
FIG. 2 is an exploded perspective view of the tool display device in FIG. 1.
Figure 3:
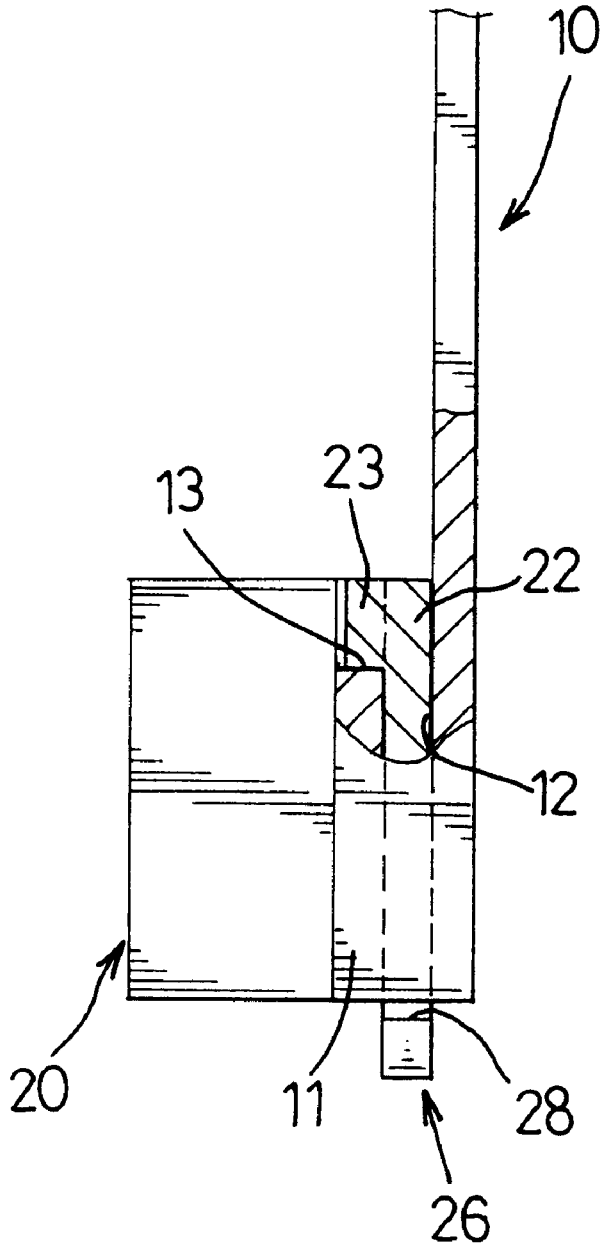
FIG. 3 is an enlarged side plan view in partial section of a retaining device of the tool display device along line 3—3 in FIG. 1.

With reference to FIGS. 1 to 3, a tool display device is comprises of a back-plate (10) and a tool bracket (20). The tool bracket (20) is detachably mounted on the back-plate (10) to hold a tool (not shown) between the back-plate (10) and the tool bracket (20).

The back-plate (10) is rectangular and has a bottom, a top, two sides and four corners. A holding plate (11) with a top, a bottom and two sides is attached to each side of the back-plate (10) and extends toward the other holding plate (11). A mounting slot (12) is defined between each holding plate (11) and the back plate (10), and a notch (13) is defined through the top of each holding plate (11).

The tool bracket (20) has a middle portion and two sides. A receiving space (21) with an opening (not numbered) is defined in a middle portion of the tool bracket (20). The opening faces to the back-plate (10). Two ears (22) are respectively formed at opposite sides of the tool bracket (20) to correspond to the mounting slots (12) on the back-plate (10). Each ear (22) has a top, a bottom, a nub (23) and a cutout (25). The nub (23) is formed at the top of the ear (22)

to engage the notch (13) in the holding plate (11). The cutout (25) is defined in the bottom of the ear (22) to form an inside leg (not numbered) and a resilient outside leg (26) at the bottom of the ear (22). The resilient outside leg (26) has a distal end that extends downward beyond the bottom of the tool bracket (20), the holding plate, and the back-plate (10). A hook (27) with a top flat face (28) is formed on the distal end of the resilient outside leg (26).

Figure 4:
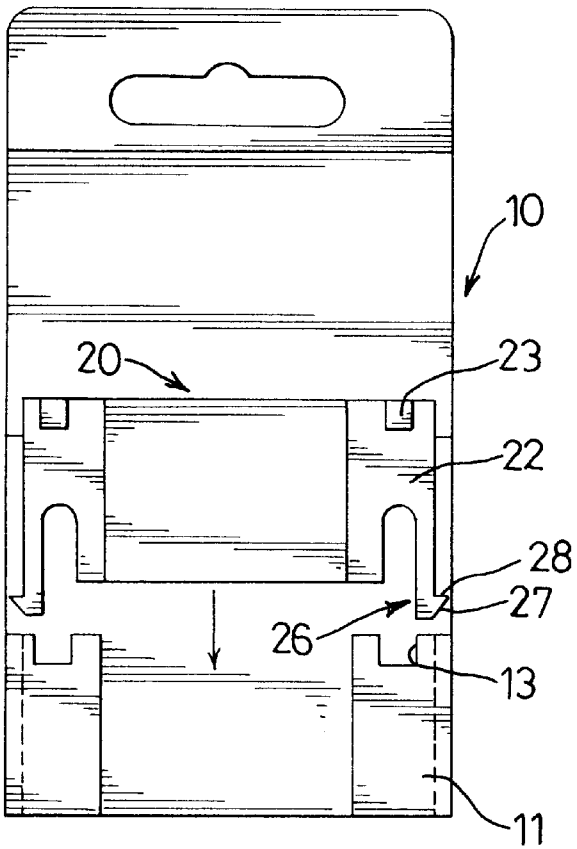
FIG. 4 is an operational front plan view of the tool display device in FIG. 1.

With reference to FIGS. 2 to 4, when attaching the tool bracket (20) on the back-plate (10) the tool bracket (20) moves downward along the back-plate (10) so the ears (22) slide into the corresponding mounting slots (12). The resilient outside leg (26) is compressed within the mounting slot (12) because the hook (27) is pressed inward. The tool bracket (20) moves downward until the nub (23) rests inside the notch (13) and the hook (27) on the resilient outside leg (26) extends beyond the bottom of the holding plate (11) to prevent the tool bracket (20) from sliding up to achieve anti-thief feature. Therefore, only one step is needed to assemble the tool display device.

Figure 5:
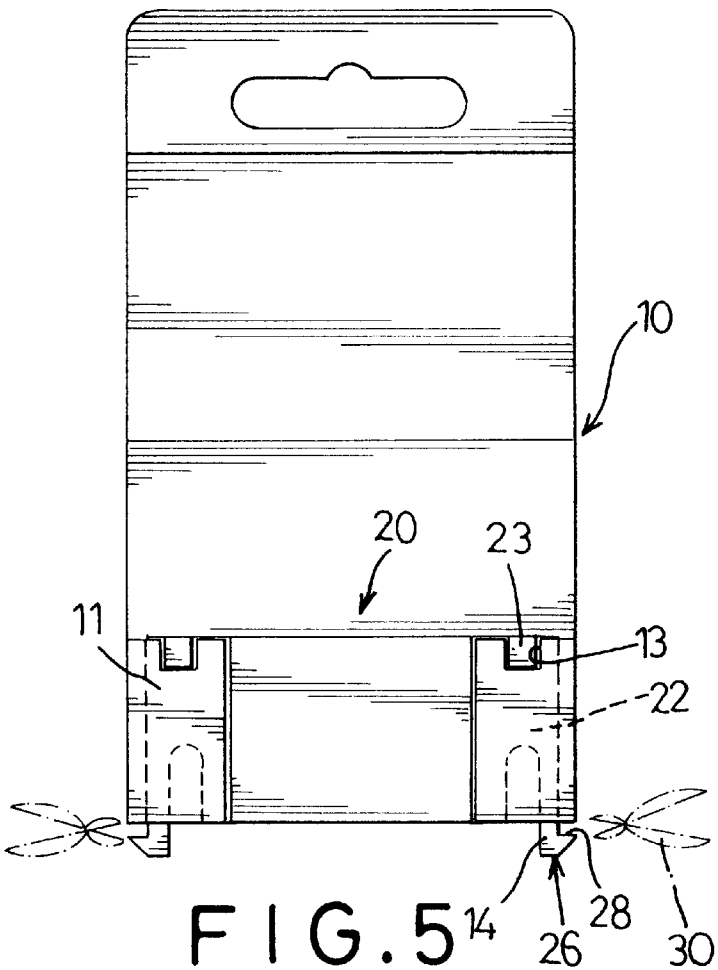
FIG. 5 is an operational front plan view of the tool display device, in FIG. 1.

With reference to FIGS. 3 and 5, to remove the tool from the tool display device, scissors (30) are used to cut the hook (27) off so the tool bracket (20) can be slid up to and be detached from the back-plate (10). Additionally, the top flat face (28) of the hook (27) extends beyond the bottom of the holding plate (11) to form a gap between the hook (27) and the holding plate (11) so that the scissors (30) can cut the hook (27) off the resilient outside leg (26) easily. After cutting the hook (27) off the resilient outside leg (26), the tool bracket (20) can be easily detached from or attached to the back-plate (10) so the tool display device can be used to store tools. Since the nub (23) and notch (13) are not easily broken, the tool display device is durable for holding a tool.

Figure 6:
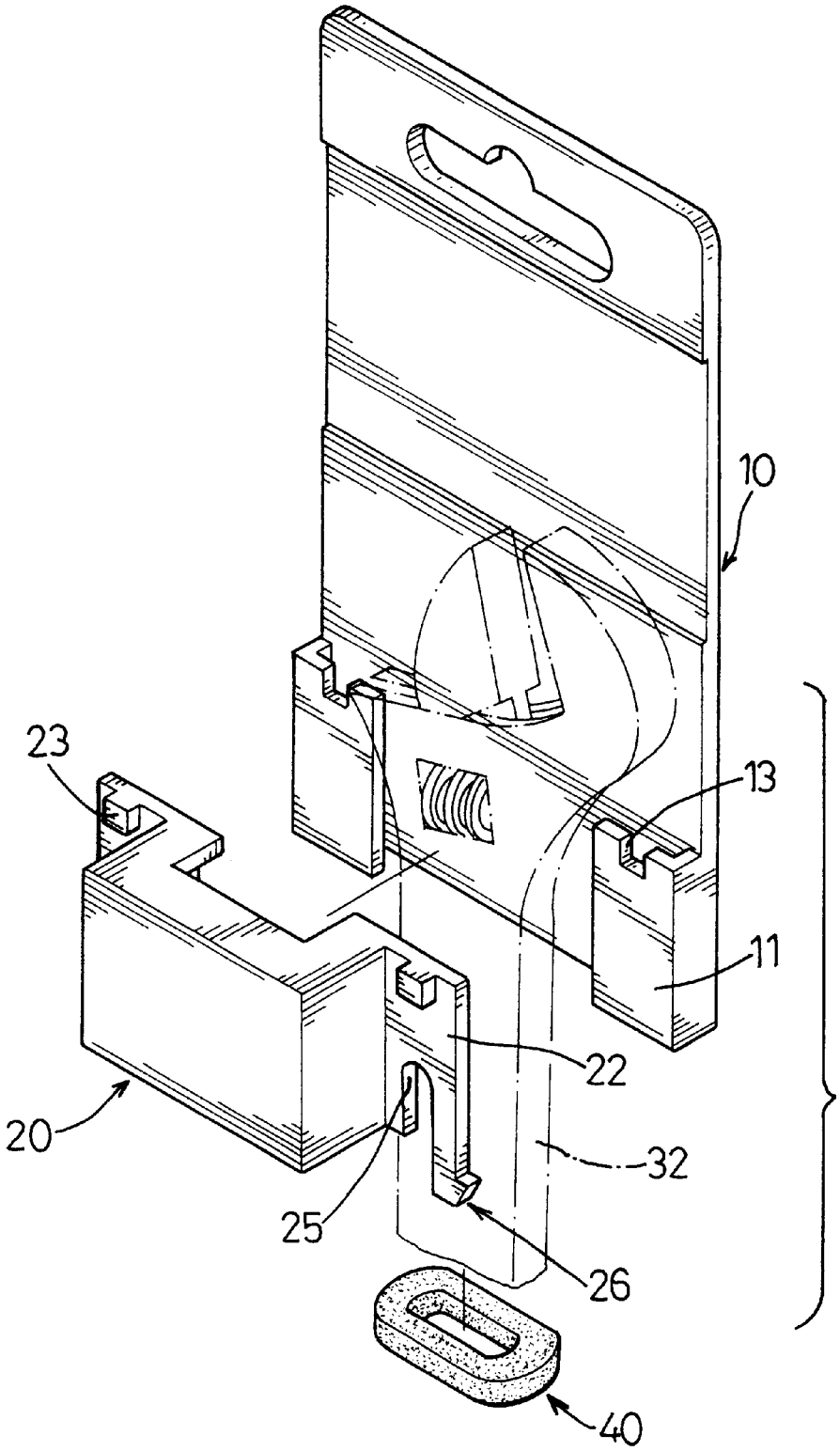
FIG. 6 is an exploded perspective view of the tool display device in FIG. 1, wherein a mounting cushion is mounted on the tool inside the receiving space.
Figure 7:
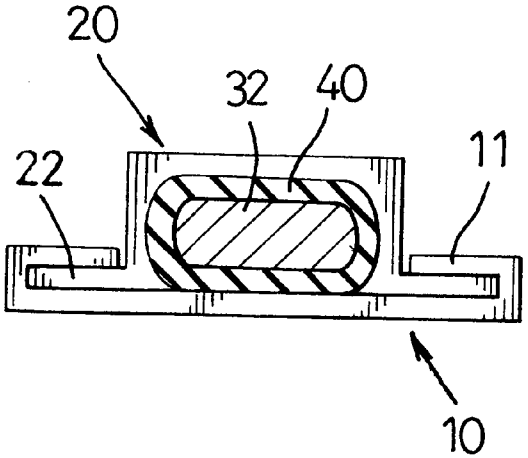
FIG. 7 is a cross-sectional top plan view of the tool display device in FIG. 6.

With reference to FIGS. 6 and 7, a second embodiment of the tool display device in accordance with the present invention improves the stability a tool suspended on the device. At least one cushion is mounted on the tool between the back-plate (10) and the tool bracket (20). A wrench (32) having a handle is secured inside the receiving space (21) between the back-plate (10) and the tool bracket (20). A first mounting cushion (40) is essentially rectangular and mounts around the handle of the wrench (32) abut the bottom face of the tool display device for damping the rock of the tool or to fill space between the handle and the tool display device. Therefore, the wrench (32) does not tilt or swing in the receiving space (21) and is kept straight.

Figure 10:
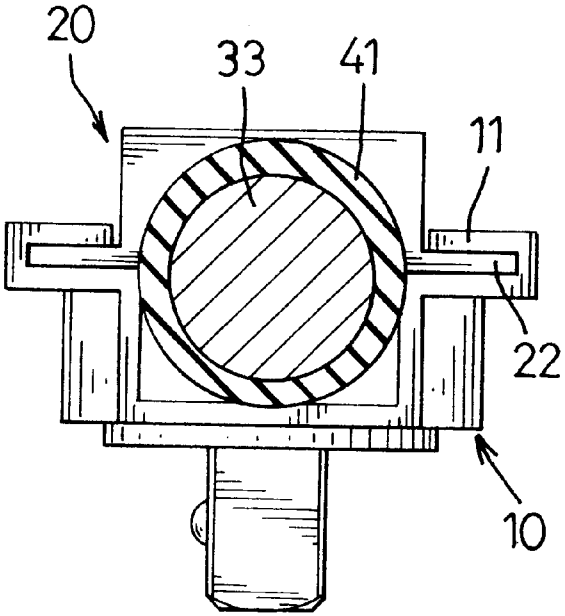
FIG. 10 is a cross-sectional top view of the second embodiment of the tool display device in FIG. 9.
Figure 8:
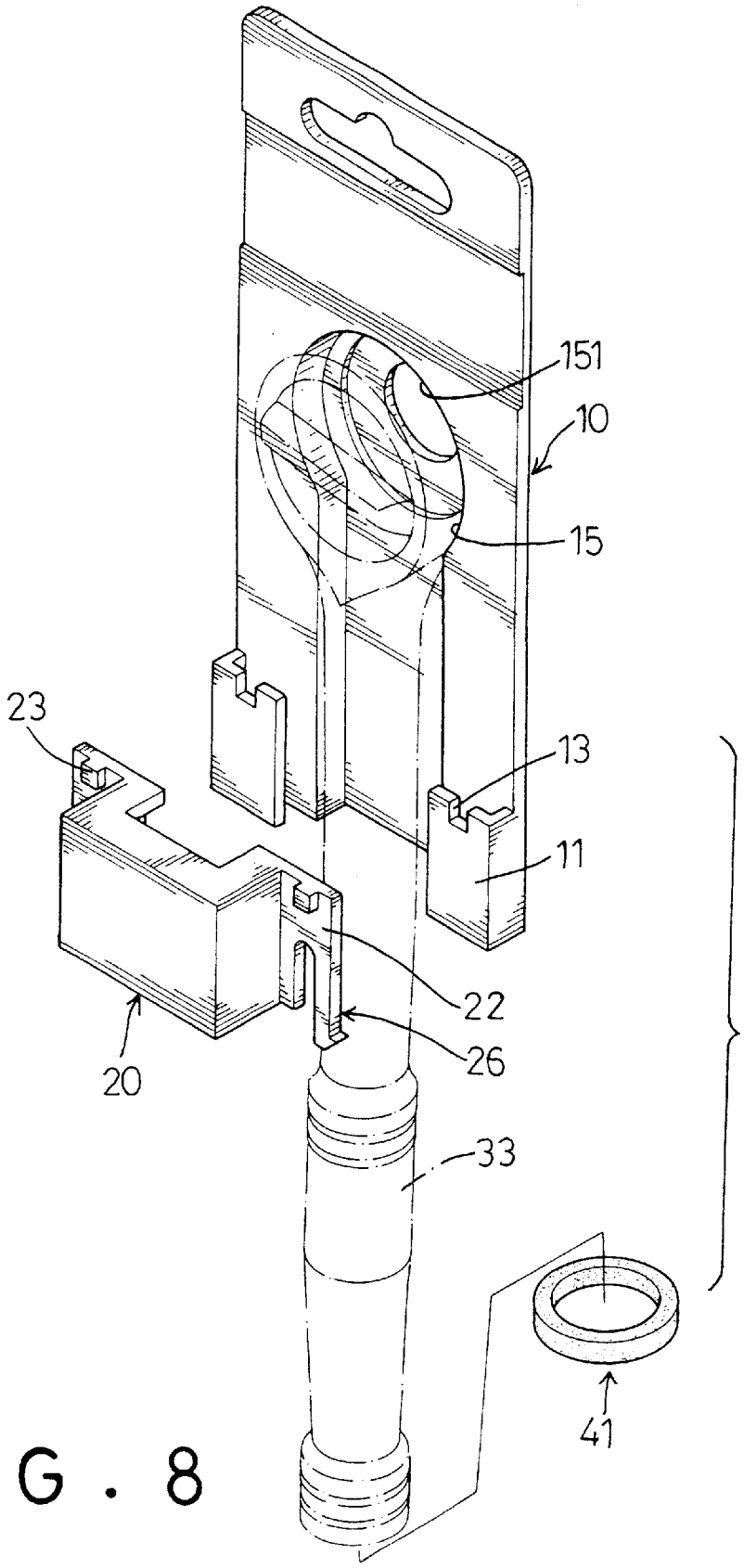
FIG. 8 is an exploded perspective view of a second embodiment of the tool display device in accordance with the present invention, wherein the mounting cushion is circular.
Figure 9:
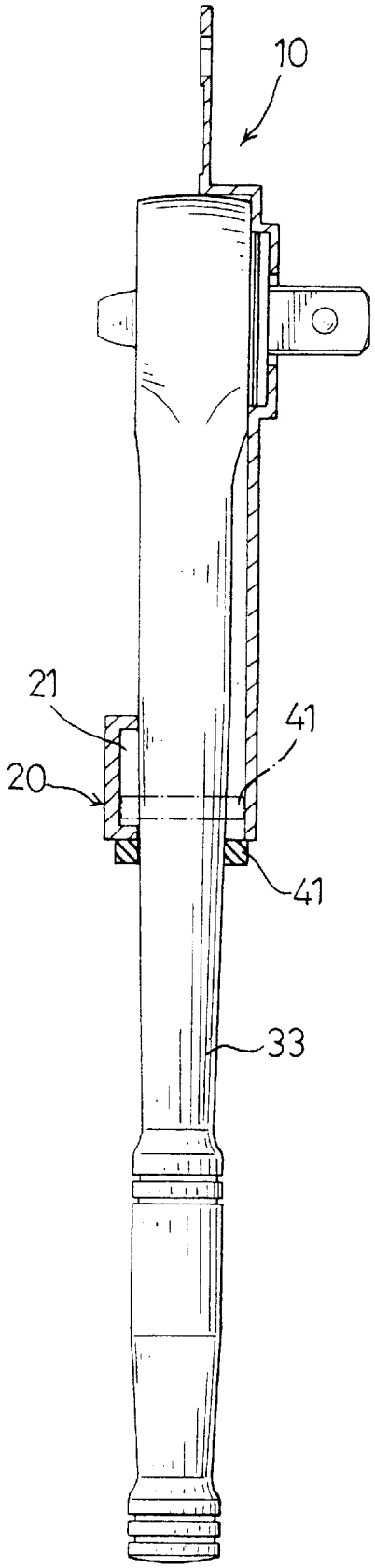
FIG. 9 is a cross-sectional side plan view of the second embodiment of the tool display device in FIG. 8.

With reference to FIGS. 8 to 10, a third embodiment of the tool display device has a tool head recess (15) defined in the in the back-plate (10) to partially receive a tool head inside. A ratchet wrench (33) having a round handle is held between the back-plate (10) and the tool bracket (20). A second mounting cushion (41) is circular and mounted around the round handle to abut the bottom face of the tool display device for damping the rock of the tool or to fill space between the handle and the tool display device.

Figure 11:
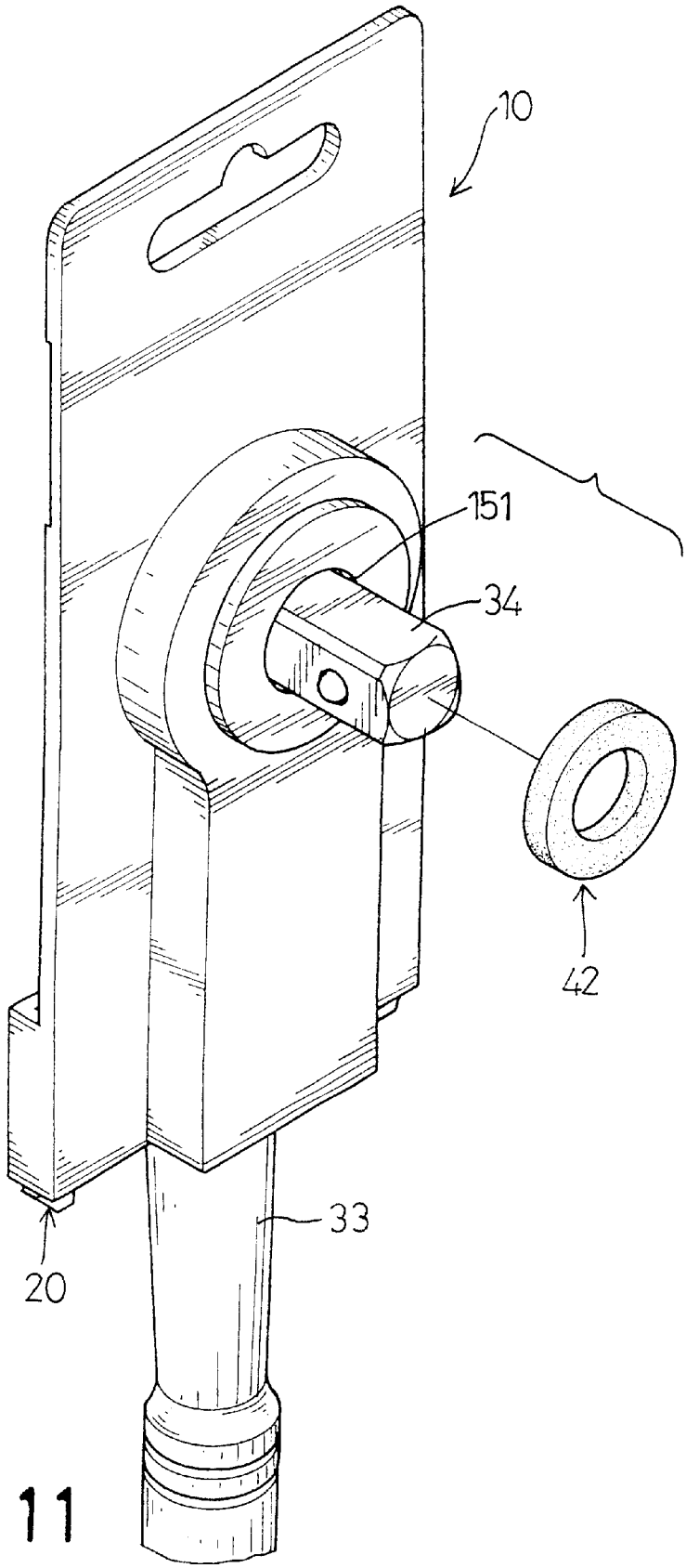
FIG. 11 is a perspective view of a third embodiment of the tool display device in accordance with the present invention, wherein the tool has a connecting head extending through the back-plate and a second mounting cushion is mounted on the connecting head.
Figure 12:
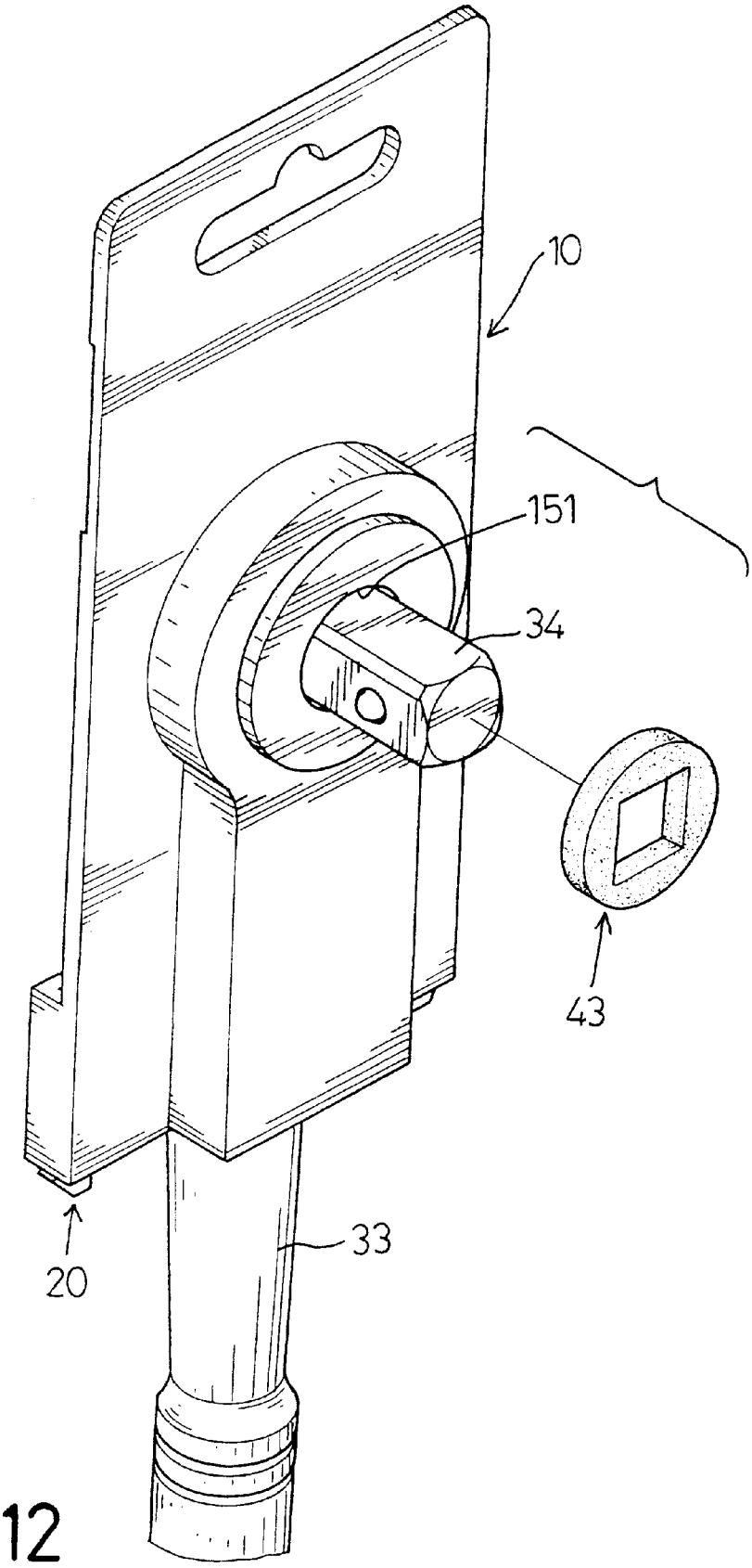
FIG. 12 is a perspective view of a fourth embodiment of the tool display device in accordance with the present invention, wherein the second mounting cushion has a rectangular through hole.
Figure 13:
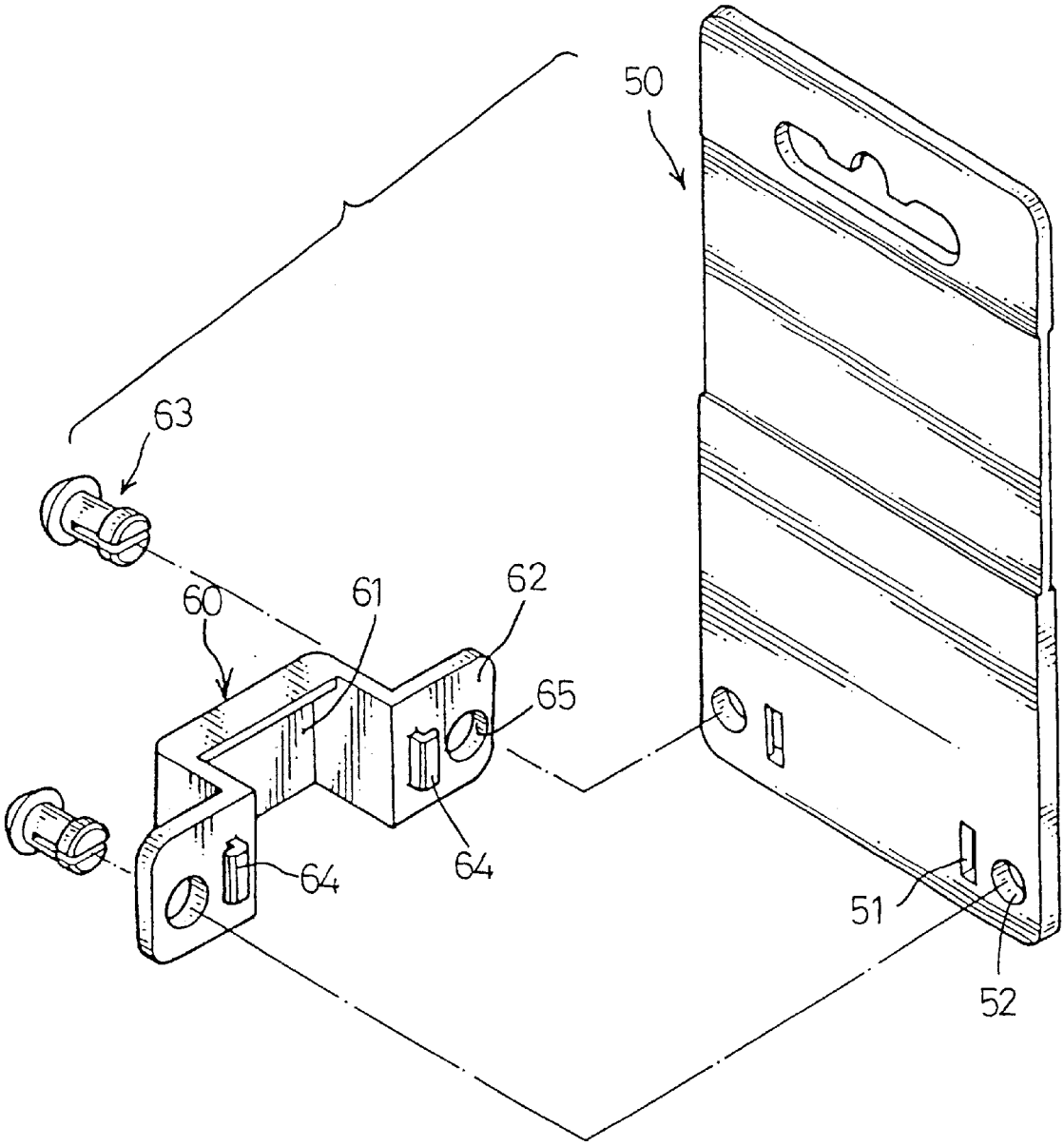
FIG. 13 PRIOR ART
FIG. 13 is an exploded view of a conventional tool display device in accordance with the prior art.

With reference to FIGS. 8, 11 and 12, the back-plate (10) further has a through hole (151) defined through the tool head recess (15), and the wrench (33) has a connecting rod (34) that extends through the through hole (151). A third mounting cushion (42) with a securing hole is mounted around the connecting rod (34) and attaches to the back-plate (10) to secure the wrench (33) stably on the tool display device. In FIG. 11, the securing hole is circular and in FIG. 12, the securing hole is rectangular.

According to above description, the tool display device in accordance with the present invention has the following advantages.

1. When assembling the tool display device, the tool bracket (20) attaches to the back-plate (10) by sliding the ears (22) into the mounting slot (12) of the back-plate (10). The nub (23) is received in the notch (13) and the hook (27) extends out of the mounting slot (12) to secured the tool bracket (20) on the back-plate (10) and to prevent the tool bracket (20) from sliding up to achieve an anti-thief feature. Therefore, the manufacturer only needs one step to quickly assemble the tool display device.

2. Because the back-plate (10) and the tool bracket (20) are formed as individual pieces by injection molding, there is no need to produce an extra element to lock the pieces together. Therefore, production cost is reduced.

3. The mounting cushion mounted on the tool works with the back-plate (10) and the tool bracket (20) to prevent the tool from tilting or swinging when the tool is secured on the tool display device.

Even though numerous characteristics and advantages of the present invention have been set forth in the foregoing description, together with details of the structure and function of the invention, the disclosure is illustrative only, and changes nay be made in detail, especially in matters of shape, size, and arrangement of parts within the principles of the invention to the full extent indicated by the broad general meaning of the terms in which the appended claims are expressed.

What is claimed is:

1. A tool display device adapted to hold a tool, and comprising:

a back-plate (10) that is rectangular and has a bottom, a top, two sides and four corners, and the back-plate (10) having two holding plates (11) attached to the two sides of the back-plate (10) at corners near the bottom and extending toward each other, each holding plate (11) having a top, a bottom and two sides;

a mounting slot (12) defined between each holding plate (11) and the back-plate (10); and a notch (13) defined through the top of each holding plate (11); and a tool bracket (20) detachably mounted on the back-plate (10) and having a middle portion;

two sides;

a receiving space (21) with an opening in the middle portion facing the back-plate (10); and two ears (22) respectively formed at the two sides of the tool bracket (20) to correspond to the mounting slots (12) of the back-plate (10), wherein each ear (22) has a top, a bottom, a nub (23) formed at the top of the ear (22) to engage the notch (13) in the respective holding plate (11), a cutout (25) defined in the bottom of the ear (22) to form a resilient outside leg (26) with a distal end that extends beyond the bottom of the respective holding plate (11) when the tool bracket (20) is mounted on the back-plate (11), and a hook (27) with a top flat face (28) formed on the distal end of the resilient outside leg (26).

2. The tool display device as claimed in claim 1, wherein the back-plate (10) further has a tool head recess (15) defined in the back-plate (10).

3. A tool display device adapted to hold a tool with a handle, and comprising:

a back-plate (10) that is rectangular and has a bottom, a top, two sides and four corners, and the back plate (10) having;

two holding plates (11) attached to the two sides of the back-plate (10) at corners near the bottom and extending toward each other, each holding plate (11) having a top, a bottom and two sides;

a mounting slot (12) defined between each holding plate (11) and the back-plate (10); and a notch (13) defined through the top of each holding plate (11); and a tool bracket (20) detachably mounted on the back-plate (10) and having a middle portion, two sides;

a receiving space (21) with an opening in the middle portion facing the back-plate (10); and two ears (22) respectively formed at the two sides of the tool bracket (20) to correspond to the mounting slots (12) of the back-plate (10), wherein each ear (22) has a top, a bottom, a nub (23) formed at the top of the ear (22) to engage the notch (13) of the respective holding plate (11), a cutout (25) defined in the bottom of the ear (22) to form a resilient outside leg (26) with a distal end that extends beyond the bottom of the respective holding plate (11) when the tool bracket (20) is mounted on the back-plate (11), and a hook (27) with a top flat face (28) formed on the distal end of the resilient outside leg (26); and at least one mounting cushion (40) adapted to attach around the tool to damp rocking of the tool and secure the tool on the tool display device.

4. The tool display device as claimed in claim 3, wherein the back-plate (10) further has a tool head recess (15) defined in the back-plate (10).

5. The tool display device as claimed in claim 4 further comprising a through hole (151) defined in the back-plate (10) at a face defining the tool head recess (15); and a mounting cushion (42) adapted to be mounted around a connecting rod (34) of the tool extending through the through hole (151), and abutting the back-plate (10) to hold the tool on the tool display device.

6. The tool display device as claimed in claim 3, wherein the mounting cushion (40) is adapted to be mounted around the handle of the tool inside the receiving space (21).

7. The tool display device as claimed in claim 6, wherein the top flat face of the hook (27) extends a distance beyond the bottom of the holding plate (11).

8. The tool display device as claimed in claim 6, wherein the mounting cushion is rectangular and has a rectangular through hole.

9. The tool display device as claimed in claim 6, wherein the mounting cushion is rectangular and has a circular through hole.

10. The tool display device as claimed in claim 6, wherein the mounting cushion is circular and has a rectangular through hole.

11. The tool display device as claimed in claim 6, wherein the mounting cushion is circular and has a circular through hole.

12. The tool display device as claimed in claim 3, wherein the mounting cushion (40) is adapted to be mounted around the handle of the tool and be abutted to a bottom face of the tool display device.

13. The tool display device as claimed in claim 12, wherein the top flat face of the hook (27) extends a distance beyond the bottom of the holding plate (11).

14. The tool display device as claimed in claim 12, wherein the mounting cushion is rectangular and has a rectangular through hole.

15. The tool display device as claimed in claim 12, wherein the mounting cushion is rectangular and has a circular through hole.

16. The tool display device as claimed in claim 12, wherein the mounting cushion is circular and has a rectangular through hole.

17. The tool display device as claimed in claim 12, wherein the mounting cushion is circular and has a circular through hole.

18. The tool display device as claimed in claim 3, wherein the top flat face of the hook (27) extends a distance beyond the bottom of the holding plate (11).

* * * * *